US005752289A

United States Patent [19]

Collins

[11] Patent Number: 5,752,289

[45] Date of Patent: May 19, 1998

[54] SYSTEM AND METHOD FOR CLEANING CARPET AND THE LIKE

[76] Inventor: Dale T. Collins, P.O. Box 3184, Crossville, Tenn. 38555

[21] Appl. No.: 640,136

[22] Filed: Apr. 30, 1996

[51] Int. Cl.[6] ..... A47L 9/02

[52] U.S. Cl. ..... 15/421; 15/321; 15/322; 15/375

[58] Field of Search ..... 15/375, 421

[56] References Cited

U.S. PATENT DOCUMENTS

| | | | |
|---|---|---|---|
| 953,825 | 4/1910 | Gekeler | 15/421 |
| 1,106,231 | 8/1914 | Marshall | 15/421 X |
| 2,096,595 | 10/1937 | Sanford | 15/421 X |
| 2,326,311 | 8/1943 | Taylor | 15/375 |
| 4,275,474 | 6/1981 | Woodard | 15/421 X |
| 5,263,224 | 11/1993 | Lovelady | 15/375 X |

*Primary Examiner*—Chris K. Moore
*Attorney, Agent, or Firm*—Michael E. McKee

[57] ABSTRACT

A system for cleaning carpets and other textiles utilizing an applicator wand with which a cleaning liquid is spray-applied to the carpet and with which the cleaning liquid and loosened debris are removed from the carpet under the influence of a vacuum created by a vacuum pump. The applicator wand includes an operator-controlled aerator valve through which air can be introduced into the flow of cleaning liquid routed to the dispensing nozzles of the wand to thereby permit an operator to readily adjust the condition of the liquid being applied to the carpet between an aerated and a non-aerated condition. In addition, the applicator wand utilizes a flow restrictor valve to limit the strength of the vacuum generated at the lower edges of the wand at an amount acceptable to pull a substantial amount of liquid from the carpet while preventing the creation of an undesirable seal between the lower edges of the wand and the carpet. In addition, a dryer attachment for use with the vacuum of the system utilizes a rotatable brush for disturbing the fibers of the carpet as the attachment is moved thereacross, an air-powered turbine for rotating the brush, and a blower and air-heating components for introducing heated air over the fibers of the carpet being disturbed by the brush.

5 Claims, 5 Drawing Sheets

SYSTEM AND METHOD FOR CLEANING CARPET AND THE LIKE

BACKGROUND OF THE INVENTION

This invention relates generally to the means and methods for cleaning carpets and other textiles and relates, more particularly, to the means and methods with which these textiles are wet-cleaned and then dried.

The wet cleaning of a carpet commonly involves the application of a liquid cleaning solution, under pressure, to an area of the carpet being cleaned and then the vacuuming of the liquid solution from the carpet. The liquid cleaning solution may be comprised primarily of water or a mixture of water and detergent intended to loosen dirt and debris from the fabric of the carpet so that by subsequently vacuuming the liquid from the carpet, the dirt and debris are drawn from the carpet with the liquid.

Tools used in the application of a liquid to the carpet commonly include an applicator (i.e. a wet) wand having a plurality of dispensing nozzles and a flow conduit joined to the nozzles. By routing the liquid through the flow conduit from a pressurized source and then moving the wand over the areas of carpet to be cleaned, the liquid is dispensed through the nozzles in a spray pattern toward the carpet areas. Such an applicator wand is limited, however, in that no means are provided at the wand by which the depth of carpet penetration by the liquid can be altered. In other words, as far as conventional applicator wands are concerned, an operator cannot easily vary the depth of the carpet being wetted with the liquid being dispensed from the wand.

It is therefore an object of the present invention to provide a new and improved wand for use in the application of a liquid to a carpet wherein the condition of the liquid being dispensed through the applicator nozzles can be altered at the wand for altering the depth of penetration at the liquid.

For removing the cleaning liquid and debris from the carpet, there is commonly associated with the applicator wand a vacuum system, a hood having a downwardly-opening mouth and a vacuum conduit which is connectable to a vacuum source. Upon energizing the vacuum at the source and moving the wand over the areas of the carpet from which liquid is desired to be removed, the liquid is drawn from the carpet by way of the conduit toward the vacuum source. Common vacuum systems are limited, however, in that the vacuum created within the wand may be so strong that as the wand is directed over carpet, an undesirable seal is created between the lower edges of the mouth of the wand and the material of the carpet so that little, if any, air is permitted to pass between the surface of the carpet and the lower edges of the mouth of the wand. Of course, if only a small amount of air is permitted to pass between the carpet and the edges of the mouth, only small amount of liquid will be removed by the vacuum system.

Accordingly, another object of the present invention is to provide a new and improved applicator wand for use with a vacuum source which reduces the likelihood that an undesirable seal will be created between the surface of the carpet and the lower edges of the mouth of the wand so that the liquid-removal capacity of the wand is enhanced.

Another object of the present invention is to provide a new and improved attachment for use with a vacuum source for promoting the drying of the carpet following a wet-cleaning operation.

Yet another object of the present invention is to provide an applicator wand or a dryer attachment for use in conjunction with a vacuum carpet-cleaning system which are uncomplicated in construction and effective in operation.

SUMMARY OF THE INVENTION

This invention resides in an applicator wand and an associated method and a dryer attachment for use with a system for cleaning carpets and the like.

The applicator wand is used for dispensing a liquid, under pressure, toward a carpet, and includes a handle and means defining a conduit supported by the handle for conducting liquid, under pressure, from a source of liquid toward the carpet. The applicator wand also includes means associated with the conduit through which air is introduced into the conduit to thereby alter the condition of the liquid conducted therethrough toward the carpet between an aerated condition and a non-aerated condition.

The method of the invention includes the steps of providing a conduit through which a liquid, under pressure, is conducted from a source toward a carpet, and introducing air into the conduit along which the liquid is being conducted to thereby alter the condition of the liquid conducted therethrough toward the carpet between an aerated condition and a non-aerated condition.

The applicator wand of the invention is also employed for removing liquid from a carpet and includes an elongated conduit connectable at one end to a vacuum source for drawing liquid from the carpet through the other end of the conduit wherein the conduit includes a hood portion at the other end of the conduit wherein the hood portion has a mouth having edges which contact the carpet during use of the wand, and the hood portion includes a port disposed downstream of the mouth. The applicator wand also includes valve means associated with the port for limiting the pressure of the vacuum generated within the conduit to a pressure which is no greater than a preselected level to reduce the likelihood that a seal will be formed between the edges of the mouth of the hood portion and the carpet which would restrict the flow of air between the edges of the mouth and the carpet.

The dryer attachment is for use with a vacuum source for enhancing the drying of a carpet having fibers and includes a head including means defining a downwardly-opening compartment and means for connecting the downwardly-opening compartment in flow communication with the vacuum source so that air drawn by the vacuum source pulls air through the downwardly-opening compartment. A rotatable brush is mounted for rotation within the head for disturbing the fibers of the carpet when the brush is rotated relative to the head, and means are included within the attachment for rotating the brush relative to the head in conjunction with the pulling of air through the downwardly-opening compartment by the vacuum source so that the pulling of air through the downwardly-opening compartment rotates the brush and thereby effects a disturbance of the fibers of the carpet so that the exposure of the carpet fibers to the air being pulled through the head is enhanced.

DETAILED DESCRIPTION OF THE ILLUSTRATED EMBODIMENTS

Figure 1:
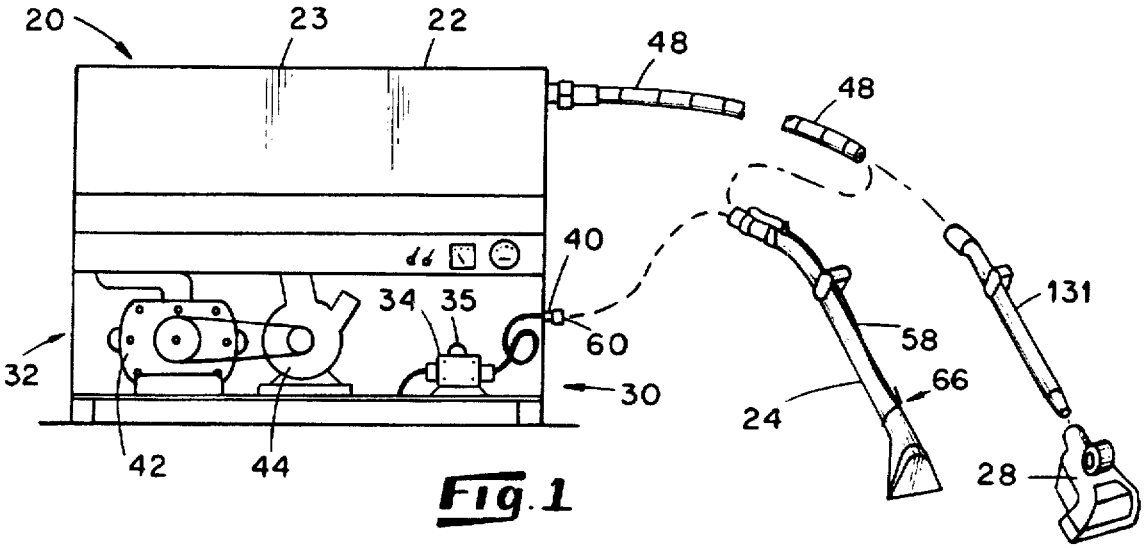
FIG. 1 is a side elevational view, shown partially in perspective and partially in section, of components of a carpet-cleaning system within which features of the present invention are embodied.

Turning now to the drawings in greater detail, there is illustrated in FIG. 1 a carpet cleaning system, generally indicated 20, within which features of the present invention are embodied. The system 20 includes a base unit 22 which may be positioned in a stationary condition upon a floor or, in the alternative, mounted upon a truck (not shown) for transport of the unit 22 between job sites and an assortment of attachments or accessories, described herein, for connection to the base unit 22 for use during selected stages of a carpet cleaning operation. One of these attachments is an applicator (i.e. wet) wand 24 with which a liquid medium, such as water or a cleaning solution, is applied to an area of a carpet desired to be cleaned, and which is also used for removing the applied liquid and loosened dirt from the carpet. A second attachment is a dryer attachment 28 for enhancing the drying of the carpet.

Although the cleaning system 20 is described herein in connection with the cleaning of a carpet, the system 20 may find use in the cleaning of textiles or other floor-covering fabrics, such as rugs and upholstery. Accordingly, the principles of the present invention can be variously applied.

Figure 2:
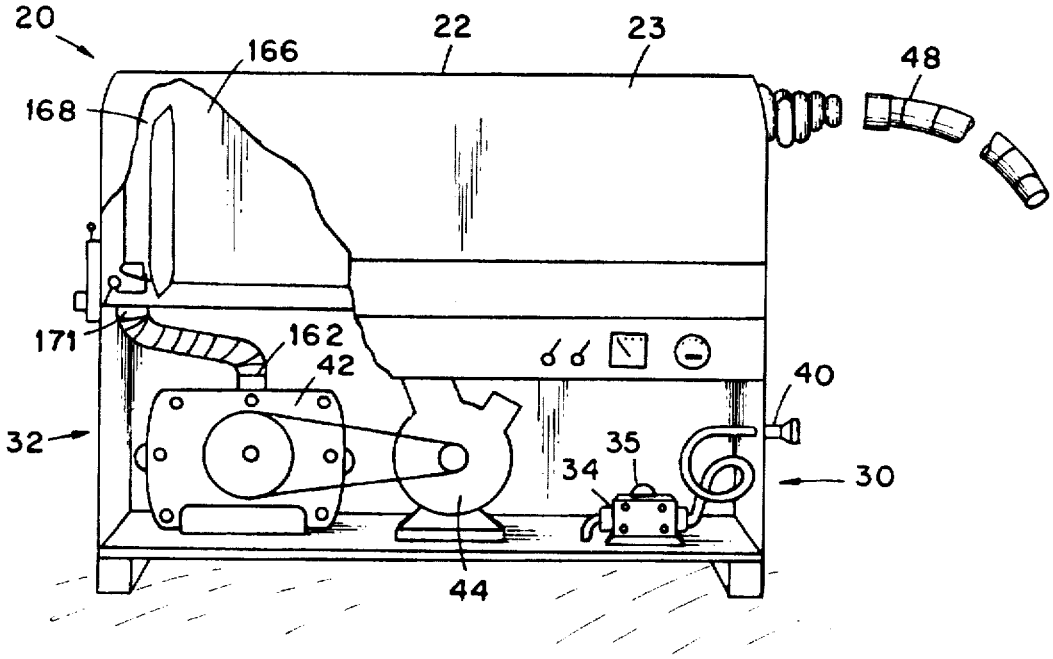
FIG. 2 is a side elevational view of the base unit component of the FIG. 1 system, drawn to a slightly larger scale and shown partially cut-away.

With reference to FIGS. 1 and 2, the base unit 22 includes means, generally indicated 30, for delivering liquid to the applicator wand 24 under pressure and also includes means, generally indicated 32, for generating a vacuum for withdrawing dirt and liquid from the carpet by way of the applicator wand 24. The depicted unit 22 includes a cabinet 23, and the fluid-delivery means 30 is in the form of a pump 34 and an associated motor 35 mounted within the cabinet 23 for pumping fluid from a reservoir (not shown) and through a pipe 40. The vacuum-generating means 32 includes a vacuum pump 42 and an associated motor 44 mounted within the cabinet 23 for lowering the pressure within selected compartments of the cabinet 23 below that of the ambient surroundings so that materials (e.g. dirt and liquid) can be drawn into the cabinet 23 by way of a vacuum hose 48 connected at one end of the cabinet 23. One of these cabinet compartments, indicated 166 in FIG. 2, provides a reservoir for the collection of liquid and dirt drawn into the cabinet 23 by way of the hose 48.

Figure 3:
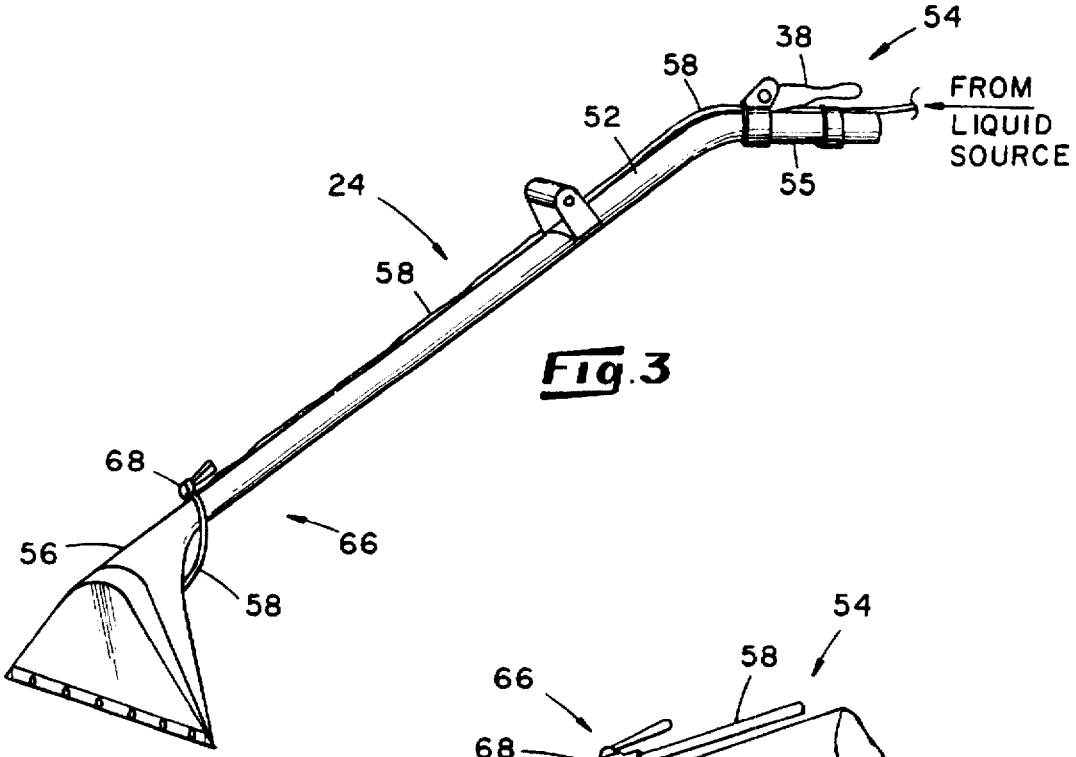
FIG. 3 is a perspective view of another of the components of the FIG. 1 system.
Figure 4:
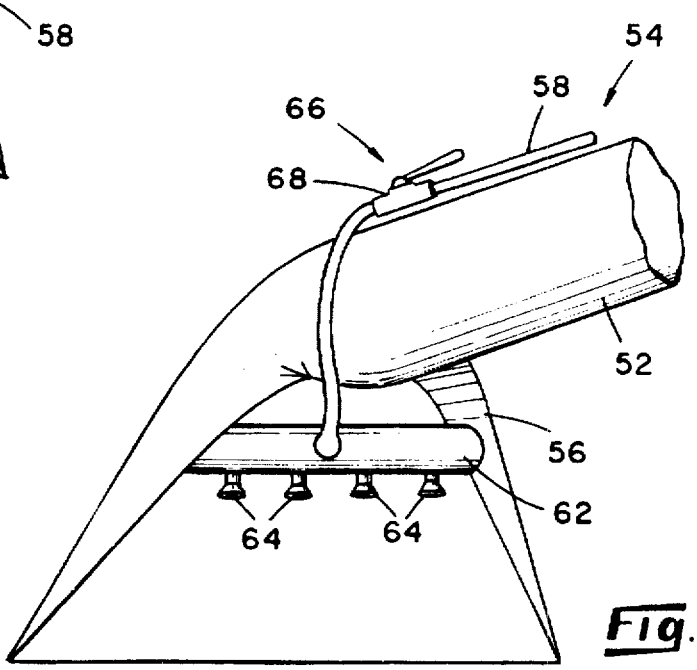
FIG. 4 is a perspective view of a fragment of the component of FIG. 3 shown generally from the back thereof.

With reference to FIGS. 3 and 4, the applicator wand 24 includes an elongated handle portion 52 and conduit means, generally indicated 54, through which liquid is conducted from the liquid-delivery means 30 (FIG. 1) to the area of a carpet being treated, i.e. cleaned, with the liquid pumped from the pump 34. To this end, the handle portion 52 (FIG. 3) of the wand 24 includes a rear section 55 adapted to be grasped by the hands of an operator for use of the wand 24 and a front section 56 which is shaped so as to provide a downwardly-opening hood for the applicator wand 24.

The conduit means 54 includes an elongated flexible tube 58 which is supportedly attached to the handle portion 52 so as to extend along a major portion of the length thereof. In addition, the tube 58 is connectable to the pipe 40 by means of a suitable coupling 60 (FIG. 1) and is joined at its other end to a manifold 62 (FIG. 4) supported within the front section 56 of the handle portion 52. A manually-operable valve 38 is joined in-line with the conduit 58 adjacent the rear of the handle portion 52 which permits an operator to selectively permit or shut off the flow of liquid from the source 30 at the wand 24.

As best shown in FIG. 4, the manifold 62 includes a series of nozzles 64 along its length through which liquid exits the manifold 62 toward the carpet being treated. It follows, therefore, that liquid pumped from the pump 34 is conducted in sequence through the tube 58 and then through the manifold 62 where it is discharged onto the carpet by way of the nozzles 64. Since the liquid is supplied to the applicator wand 24 under pressure, the liquid exits the nozzles 64 in a spray to aid in the distribution of the liquid over the area being treated. At the same time, the hood-shaped front section 56 of the handle portion 52 helps to confine the liquid spray within a selected region beneath the front section 56.

It is a feature of the applicator wand 24 that it includes adjustment means, generally indicated 66, enabling an operator to alter the condition of the liquid being discharged onto the carpet through the manifold 62. In the depicted wand 24, the adjustment means 66 includes a manually-operable aerator valve 68 connected in-line with the tube 58 so that actuation of the valve 68 permits air to be introduced into the tube 58 so that air, as well as liquid, is discharged through the nozzles 64 onto the carpet. In practice, as air is introduced through the valve 68, the air mixes with the liquid in a manner which creates bubbles within the liquid, and these bubbles retard the penetration of liquid into the carpet.

Figure 5:
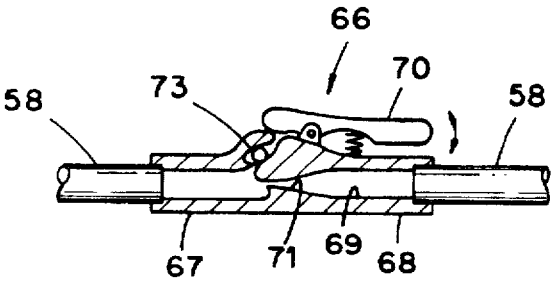
FIG. 5 is a longitudinal cross-sectional view of the aerator valve of the FIG. 3 component.

Although the aerator valve 68 may take any of a number of forms, the depicted aerator valve 68 (best shown in FIG. 5) includes a body 67 having a flow passageway 69 including a venturi-type section 71 along the length thereof and an air passageway 73 connected in flow communication with the flow passageway 69 downstream of the venturi-type section 71. By depressing the movable (spring-biased) handle, indicated 70, which is attached to the valve body 67, air is permitted to be drawn into the flow passageway 69 and mix with the liquid moving through the valve 68, and by releasing the handle 70 so that it returns to its original position before being depressed, air is prevented from entering the flow passageway 69. A ball check valve is associated with the air passageway 73 to prevent the flow of liquid out of the passageway 73.

The advantage provided by the adjustment means 66 can be readily appreciated when considering the fact that some areas of a carpet, such as those areas which are normally positioned beneath a chair, may not need as thorough a cleaning as other areas. Consequently, an operator may not need to apply cleaning liquid as deeply within these areas as within other areas. Therefore, as the operator directs the front section 56 of the applicator wand 24 over the carpet being treated, he can readily actuate the aerator valve 68 to alter the condition of the liquid between a non-aerated condition and an aerated (bubbly) condition to thereby alter the depth of penetration by the applied liquid. Therefore, the aforedescribed adjustment means 66 provides a convenient means by which an operator may readily adjust the non-aerated versus aerated condition of the liquid being discharged through the nozzles 64 of the applicator wand 24, and the adjustment means 66 is advantageous in this respect.

Figure 6:
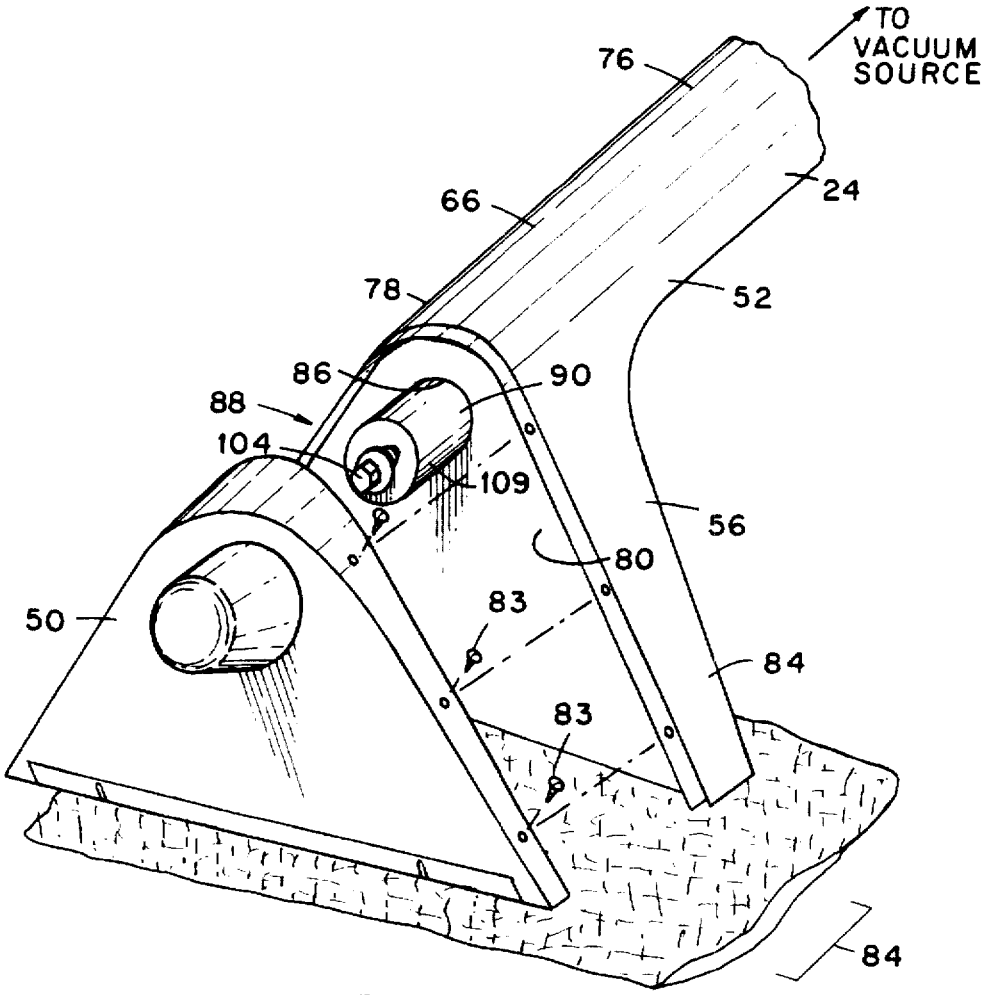
FIG. 6 is a fragmentary perspective view of still another component of the FIG. 1 system, shown exploded.
Figure 7:
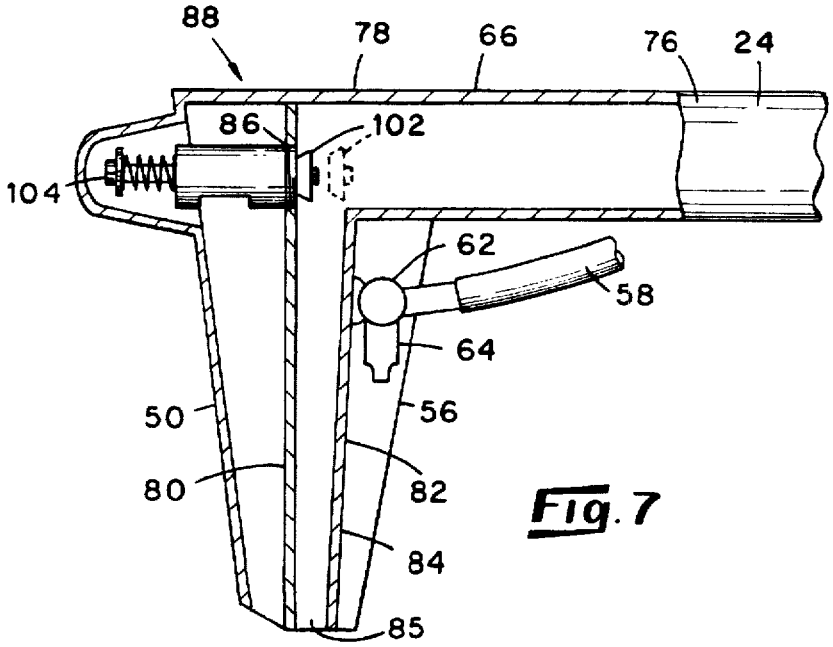
FIG. 7 is a side elevational view of the fragment of the FIG. 6 component, shown partially in longitudinal cross section.

With reference to FIGS. 6 and 7, the applicator wand 24 of the system 20 also includes a conduit 76 (housed within the handle portion 52) which is connectable at one end to the vacuum hose 48 joined in flow communication with the vacuum pump 42 and terminating at its other end in a head 78. In the depicted wand 24, the head 78 is comprised of a front piece 80 and a rear piece 82 which collectively form a unitary, downwardly-opening hood 84 having an interior which is in flow communication with the vacuum pump by way of the conduit 76 and having a mouth 85 having lower edges which are moved in contact with the carpet as the wand 24 is moved thereover. Also associated with the hood 84 is a port 86 which, upon the occurrence of a predetermined event described herein, provides flow communication between the exterior and the interior of the hood 78.

Figure 8:
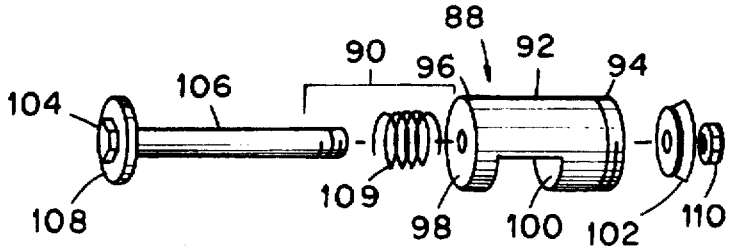
FIG. 8 is a perspective view of the restrictor valve of the FIG. 6 component, shown exploded.

It is a feature of the applicator wand 24 that it include valve means, generally indicated 88, for permitting a flow of air into the conduit 76 by way of the port 86 upon the generation of a vacuum within the hood 84 which is at least as great as a predetermined level. In the depicted wand 24, the valve means 88 includes a flow restrictor 90 secured within the port 86. To this end, the port 86 is internally-threaded, and as best shown in FIG. 8, the flow restrictor 90 includes a substantially hollow, cylindrical valve body 92 having an end 94 which is threaded within the port 86. The body end 94 is open, and the opposite end, indicated 96, is closed with a face plate 98. The body 92 also defines a side opening 100 whose purpose will be apparent herein.

The flow restrictor 90 also includes a plug 102 which is shaped to substantially close the open end 94 when fitted thereover, and a bolt and spring arrangement 104 is used to spring-bias the plug 102 toward its closed position over the end 94. In particular, the arrangement 104 includes a bolt 106 having a washer 108 positioned about the shank of the bolt 106 adjacent the head thereof and a compression spring 109 which is also positioned about the shank of the bolt 106, as best shown in FIG. 8. The shank of the bolt 106 is directed through aligned openings provided in the face plate 98 and plug 102, and a nut 110 is secured upon the end of the bolt 106 opposite the head so that the bolt 106 is secured within the cylindrical body 92. When the flow restrictor 90 is assembled in such a manner, the spring 109 continually urges the head of the bolt 106 away from the face plate 98 so that the plug 102 is biased into its closed position across the end 94.

The flow restrictor 90, in its assembled condition, is threadably secured within the port 86 so that the plug-end thereof is directed along the conduit 76 toward the vacuum pump 42. In addition, a cover plate 50 is positioned over the flow restrictor 90 as shown in FIG. 7 and secured to the remainder of the head 78 with screws 83 (FIG. 6). During normal operation of the vacuum pump 42, a vacuum is created at the pump 42 so that liquid and debris is pulled through the head 78 and conduit 76 by way of the mouth 85 of the hood 84, and the spring 109 maintains the plug 102 in its normally-closed position. However, upon creation of a vacuum within the hood 84 which is sufficient to overcome the force of the spring 109, the plug 102 is drawn, i.e. pulled, from its normally-closed position across the body end 94 to a position, as illustrated in phantom in FIG. 7, at which flow communication is established through the flow restrictor 90 and port 86 between the exterior of the hood 84 and the interior of the hood 84. In other words, upon creation of a vacuum downstream of the mouth 85 which is sufficient to overcome the biasing force of the spring 109, the plug 102 is pulled from its closed position across the body end 94 by the vacuum created at the pump, air is permitted to be drawn into the hood 84 by way of the port 86 to effectively limit the vacuum to a predetermined level (corresponding to the vacuum strength necessary to overcome the biasing force of the spring 109).

The advantage provided by the flow restrictor 90 can be readily appreciated when considering the fact that without the flow restrictor 90, the vacuum created within the hood 84 by the vacuum pump 42 may be so strong that as the wand 24 is directed over carpet, a seal is created between the carpet and the edges of the mouth 85 which prevents little, if any, air to pass between the surface of the carpet and the edges of the mount 85. Of course, if only a small amount of air is permitted to pass between the carpet and the lower edges of the mouth 85, then only small amount of liquid can be removed by the vacuum system 20 and the effectiveness of the system 20 for removing liquid from the carpet is appreciably limited. On the other hand, the flow restrictor 90 provides a vacuum-limiting valve within the port 86 which limits the strength of the vacuum created within the hood 84 to a preselected level so that throughout a vacuuming operation with the wand 24, a sufficient amount of air is permitted to continually pass between the edges of the mouth 85 and the carpet over which the wand 24 is moved. Thus, the flow restrictor 90 reduces the likelihood that air will be prevented from passing between the lower edges of the hood 84 and the carpet, and the flow restrictor 90 is advantageous in this respect. Along these lines, the spring 109 is appropriately sized to permit a flow of air into the port 86 until the creation of a vacuum within the hood 84 which is at least as high as a predetermined level (e.g. about 2.0 inches of mercury).

Figure 9:
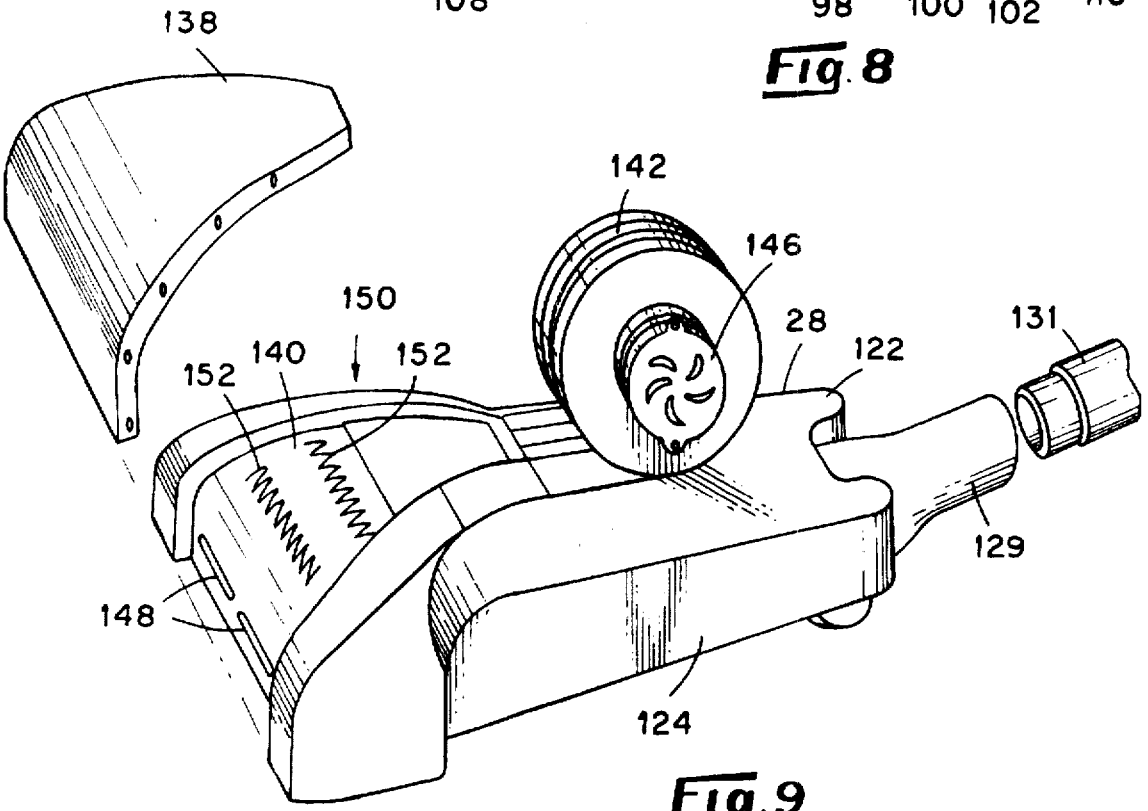
FIG. 9 is a perspective view of a further component of the FIG. 1 system, shown with its front cover removed from the remainder thereof.
Figure 10:
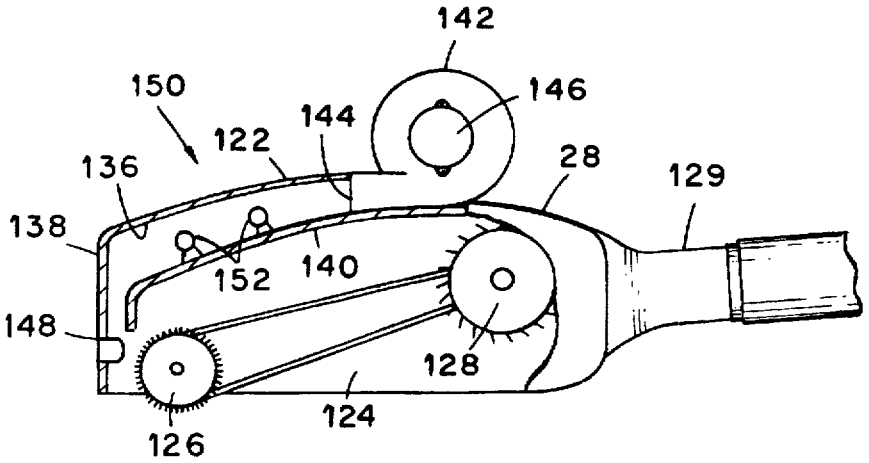
FIG. 10 is a longitudinal cross-sectional view of the FIG. 9 component illustrating schematically the air flow compartments provided therein.
Figure 11:
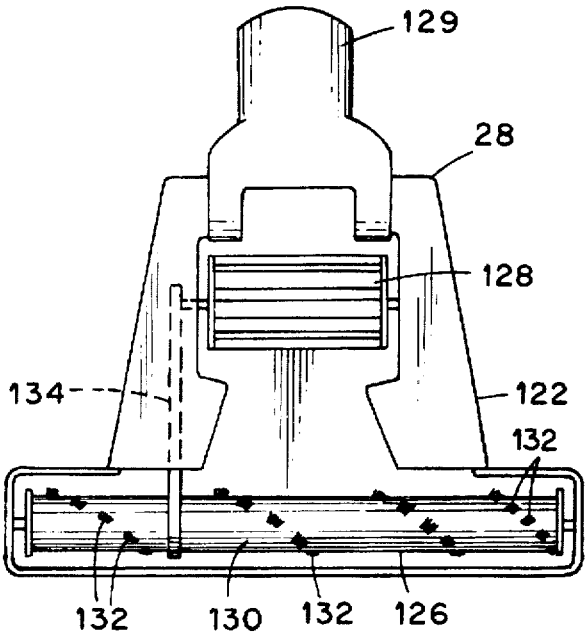
FIG. 11 is a plan view of the FIG. 9 component as viewed generally from below in FIG. 10.

With reference to FIGS. 9–11, the dryer attachment 120 of the system 20 is adapted to be attached to the vacuum pump 42 by way of the hose 48 to provide the system 20 with an enhanced carpet-drying capacity. To this end, the attachment 120 includes a head 122 having a lower, downwardly-opening compartment 124 which houses a rotatable disturbulator, or brush, assembly 126 and a rotatable turbine wheel 128, and a swivel neck portion 129 is joined to the rear of the head 122 to accommodate connection between the head 122 and the vacuum conduit 76. In the depicted system 20, a conduit-providing handle 131 (FIG. 1) is connectable intermediate of the neck portion 129 and hose 48 to facilitate movement of the head 122 by an operator.

As best shown in FIG. 11, the disturbulator assembly 126 includes a cylindrical body 130 provided with a plurality of flexible bristles 132 extending outwardly of the body 130 and is mounted adjacent the forward end of the head 122 for rotation about a substantially horizontal axis. In addition, the turbine wheel 128 is mounted within the head 122 so as to be disposed in the flow of air drawn into the vacuum conduit 76 and is connected in driving relationship with the body 130 of the assembly 126 by way of a drive belt 134. During operation of the vacuum pump 42, air is drawn through the head 122 by way of the handle 131 and hose 48 so that the turbine wheel 128 is rotated by the air flowing through the head 122, and the disturbulator assembly 126 is, in turn, forcibly rotated by the rotation of the turbine wheel 128 so that the fibers of the carpet are disturbed by the bristles 132 and the exposure of the carpet fibers to the air drawn through the head 122 is enhanced.

The head 122 also includes an upper compartment 136 having an interior which is defined between a front cover 138 and partition 140 which separates the interior of the lower compartment 124 from the interior of the upper compartment 136. A blower 142 is mounted atop the head 122 adjacent the front cover 138 so that the discharge port, indicated 144, of the blower 142 is directed into the interior of the upper compartment 136 and generally forwardly therealong. Operation of the blower 142 is had by way of an electrically-operable motor 146 mounted on one side thereof. In addition, the interior of the upper compartment 136 is in flow communication with the interior of the lower compartment 124 by way of vents 148 provided in the partition 140 adjacent the front of the head 122.

The head 122 also includes means, generally indicated 150, for heating air for introduction into the lower compartment 124 during the operation of the vacuum pump 42. In the depicted head 122, such heating means 150 includes electrical (resistance) heating elements 152 mounted upon the partition 140 so as to be positioned within the interior of the upper compartment 136. Power is supplied to the electric heating elements 152 and the blower motor 142 by way of electrical power wires (not shown) routed along the length of the conduit 76 to a power source (not shown).

During operation of the head 122, the blower 142 directs air (from the ambient surroundings) through the interior of the upper compartment 136 where the air is heated by the elements 152 before being introduced into the lower compartment 124 by way of the vents 148. As heated air is being directed into the lower compartment by the blower 142, the vacuum pump 142 draws air from beneath the lower edges of the head 122 and through the conduit 76 so that this drawn air pulls air through the carpet as well as effects a rotation of the disturbulator assembly 126 by way of the turbine wheel 128. The vacuum draws both liquid and dirt from the region of the carpet being cleaned, and the heated air introduced into the lower compartment 124 through the vents 148 helps to dry the fibers of the carpet. In addition, the disturbance of the carpet by the disturbulator assembly 126 increases the exposure of the carpet fiber to the air moving through the head 122 and further enhances the drying of the carpet.

It follows that a carpet cleaning system 20 has been described which includes an assortment of attachments which either enable an operator to readily adjust the quantity of liquid being discharged onto the carpet or enhance the liquid-removal and the drying of the carpet.

It will be understood that numerous modifications and substitutions can be had to the aforedescribed embodiment without departing from the spirit of the invention. For example, although the applicator wand 24 has been shown and described as including a relatively lengthy, round handle portion 152 enabling an operator to easily grasp and manipulate the wand 24 with two hands, an applicator wand in accordance with the present invention may include a handle of alternative size or shape and may, for example, include a short handle capable of being easily manipulated with one hand thereby promoting its use on a stairs or upon small furniture items.

Figure 12:
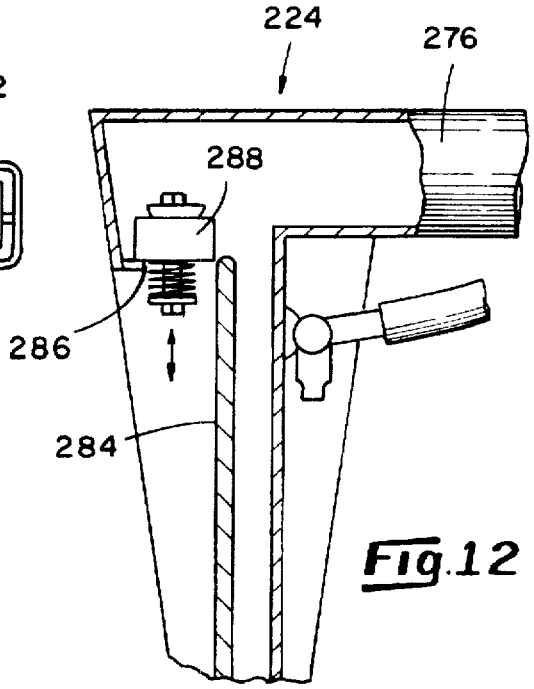
FIG. 12 is a view similar to that of FIG. 7 of an alternative embodiment of an applicator wand within which features of the present invention are embodied.

Furthermore, although the aforedescribed wand 24 has been shown and described as including valve means 88 (FIGS. 6–8) associated with a generally horizontally-opening port 86, there is shown in FIG. 12 an alternative wand 224 having a conduit 276, a hood 284 and a valve means 288 secured within a generally vertically-opening port 286.

Figure 13:
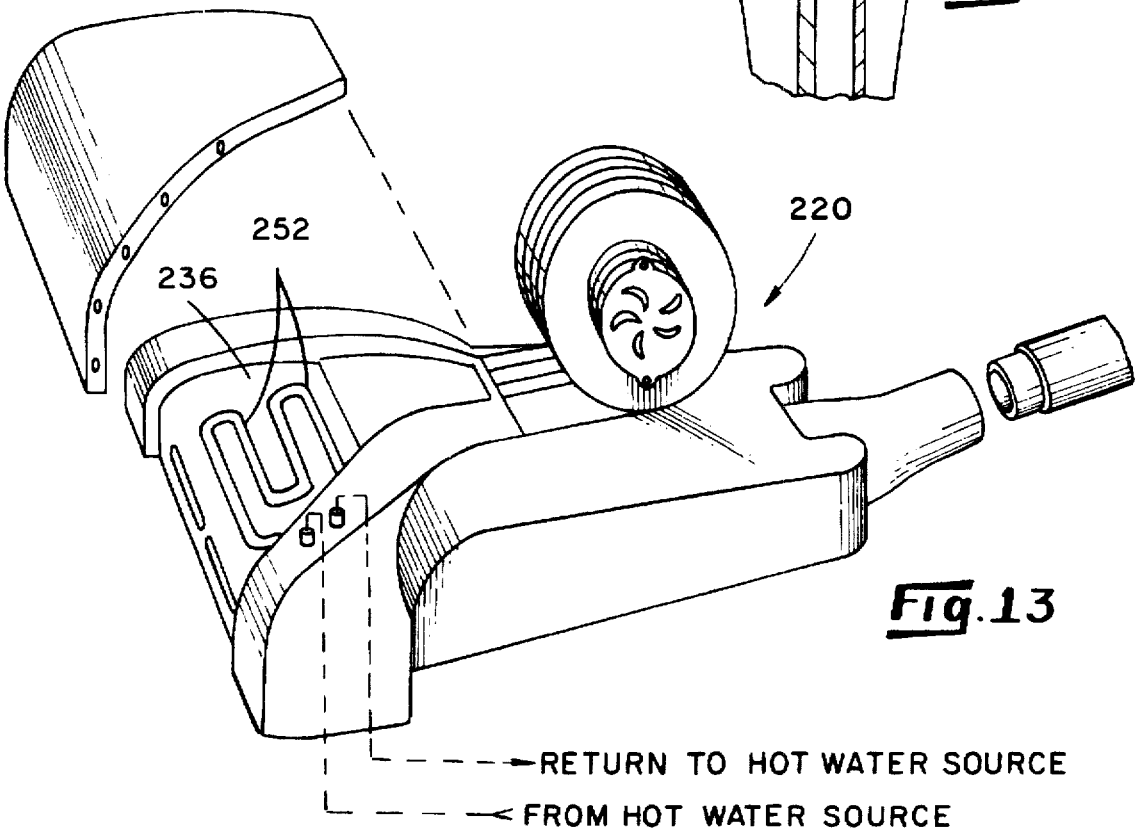
FIG. 13 is a view similar to that of FIG. 9 of still another embodiment of a system component within which features of the present invention are embodied.

Still further, although the aforedescribed dryer attachment 120 of FIGS. 9–11 has been shown and described as including electric resistance elements 152 for generating heat with which air is heated as it is moved through the upper compartment 136 of the attachment 120, there is shown in FIG. 13 an alternative dryer attachment 220 which includes water coils 252 mounted in an upper compartment 236 of the attachment 220 for heating air forced therethrough. Since many trucks which have been outfitted for use in carpet cleaning applications are also equipped for heating water, hot water can be routed to the coils 252 from these trucks and circulated through the coils 252 for heating air directed thereover.

Accordingly, the aforedescribed embodiments are intended for the purpose of illustration and not as limitation.

I claim:

1. A wand with which a liquid is removed from a carpet, the wand comprising:

an elongated conduit connectable at one end to a vacuum source for drawing liquid from the carpet through the other end of the conduit, the conduit including a hood portion at said other end of the conduit wherein the hood portion includes first and second downwardly-opening compartments wherein each of the first and second hood portion compartments has a mouth having edges which contact the carpet during a liquid-removal operation performed with the wand and a port disposed downstream of the mouths through which the interiors of the compartments are capable of communicating, the first of the hood portion compartments being in direct flow communication with a vacuum source by way of said one end of the conduit so that a vacuum is generated within the interior of the first hood portion compartment by the vacuum source during a liquid-removal operation; and valve means associated with the port for limiting the pressure of the vacuum generated within the interior of the first hood portion compartment to a preselected vacuum pressure level so that upon generation of the preselected vacuum pressure level within the first hood portion compartment, air is permitted to enter the interior of the first hood portion compartment from the interior of the second hood portion compartment thereby drawing air through the mouth of the second hood portion compartment so that all of the air which is drawn toward the vacuum source by way of the elongated conduit of the wand is drawn through one or both mouths of the first and second hood portion compartments.

2. The wand as defined in claim 1 wherein the valve means is adapted to permit a flow of air into the conduit by way of the port upon the generation of a vacuum within the hood portion which is at least as great as the preselected pressure level.

3. The wand as defined in claim 2 wherein the valve means includes a flow restrictor including a movable plug which is movable relative to the port between two positions in response to the generation of a vacuum pressure within the conduit which is at least as great as the preselected level so that upon generation of a vacuum pressure which is at least as great as the preselected level, the plug is moved to a position at which a flow of air through the port is permitted.

4. The wand as defined in claim 3 wherein the flow restrictor includes a valve body having a passageway through which air is pulled as it moves through the port toward the vacuum source, and the plug is movable relative to the valve body between a first position at which the air flow through the port is substantially shut off and a second position at which the air flow through the port is permitted, and the plug is moved from the first position toward the second position in response to the creation of a vacuum pressure within the hood portion which is at least as great as the preselected level.

5. The wand as defined in claim 4 wherein the plug is spring-biased from the second condition toward its first position so that an amount of force which is at least as great as a preselected pressure level must necessarily be exerted by the vacuum generated within the hood in order to move the plug against the force of the spring from the first position toward the second position.

* * * * *